US006779319B2

(12) United States Patent
Smith et al.

(10) Patent No.: US 6,779,319 B2
(45) Date of Patent: Aug. 24, 2004

(54) REAL-TIME INTELLIGENT PACKET-COLLATION SYSTEMS AND METHODS

(75) Inventors: Scott J. Smith, Fremont, NE (US); Jeffrey G. Nowlin, Council Bluffs, IA (US); Fred C. Casto, Omaha, NE (US)

(73) Assignee: First Data Corporation, Englewood, CO (US)

( * ) Notice: Subject to any disclaimer, the term of this patent is extended or adjusted under 35 U.S.C. 154(b) by 0 days.

(21) Appl. No.: 10/028,449

(22) Filed: Dec. 19, 2001

(65) Prior Publication Data

US 2003/0084647 A1 May 8, 2003

Related U.S. Application Data

(63) Continuation-in-part of application No. 10/036,653, filed on Nov. 8, 2001, now Pat. No. 6,670,569.

(51) Int. Cl.[7] ..... B65B 1/30

(52) U.S. Cl. ..... 53/493; 53/266.1; 53/284.3; 53/154

(58) Field of Search ..... 53/493, 266.1, 53/284.3, 154; 700/220, 221, 223, 224

(56) References Cited

U.S. PATENT DOCUMENTS

| | | | | |
|---|---|---|---|---|
| 5,034,985 A | | 7/1991 | Keough | |
| 5,125,214 A | | 6/1992 | Orsinger et al. | |
| 5,220,770 A | * | 6/1993 | Szewczyk et al. | |
| 5,317,654 A | * | 5/1994 | Perry et al. | 382/101 |
| 5,510,997 A | * | 4/1996 | Hines et al. | 700/224 |
| 5,659,481 A | | 8/1997 | Qutub et al. | |
| 5,724,791 A | | 3/1998 | Pishny et al. | |
| 5,730,299 A | * | 3/1998 | Helsley | |
| 5,745,590 A | * | 4/1998 | Pollard | 382/101 |
| 5,754,434 A | * | 5/1998 | Delfer et al. | 700/223 |
| 5,777,883 A | * | 7/1998 | Lau et al. | 700/220 |
| 6,032,122 A | * | 2/2000 | Gertner et al. | 705/8 |
| 6,119,051 A | * | 9/2000 | Anderson et al. | 700/221 |
| 6,202,005 B1 | | 3/2001 | Mahaffey | |
| 6,266,575 B1 | * | 7/2001 | Anderson et al. | 700/221 |
| 6,327,515 B1 | * | 12/2001 | Shea et al. | 700/221 |
| 6,349,242 B2 | | 2/2002 | Mahaffey | |

OTHER PUBLICATIONS

Pitney Bowes, "Direct Connect™ Inserter Control System," http://www.pb.com.

* cited by examiner

*Primary Examiner*—Stephen F. Gerrity
*Assistant Examiner*—Hemant M. Desai
(74) *Attorney, Agent, or Firm*—Townsend and Townsend and Crew LLP

(57) ABSTRACT

Systems and methods are provided for operating an inserter having hoppers from which inserts may be selected to include with a mail item. The mail item is moved sequentially, such as with a conveyor, to positions that correspond with the hoppers. At each position for the mail item, information is extracted from a job file related to how that mail item is to be processed and used to determine whether the insert from the corresponding hopper should be included with the mail item. If so, the hopper is caused to include the insert with the mail item; otherwise, the mail item is permitted to proceed to the next position without the insert being included.

15 Claims, 16 Drawing Sheets

399

Base Operating System

| IDENTIFIER | ERR | TIME | DATE | REMARKS | DEG | MISC |
|---|---|---|---|---|---|---|
| ACCUMULATOR ERROR | 25 | 14/2000 9:41:06 PM | 12:00:00 AM | | 0 | |
| ACCUMULATOR ERROR | 25 | 14/2000 9:40:57 PM | 12:00:00 AM | | 0 | |
| COLLECTOR DUMP ERROR | 35 | 14/2000 5:23:50 PM | 12:00:00 AM | | 0 | |
| COLLECTOR DUMP ERROR | 35 | 14/2000 5:23:49 PM | 12:00:00 AM | | 0 | |
| COLLECTOR DUMP ERROR | 35 | 14/2000 5:23:48 PM | 12:00:00 AM | | 0 | |
| COLLECTOR DUMP ERROR | 35 | 14/2000 5:23:47 PM | 12:00:00 AM | | 0 | |
| COLLECTOR COUNT BLOCK | 23 | 14/2000 5:23:43 PM | 12:00:00 AM | | 0 | |
| ACCUMULATOR NEW PAGE | 30 | 14/2000 5:22:15 PM | 12:00:00 AM | | 0 | |
| CUTTER NOT RESPONDING | 24 | 14/2000 5:13:00 PM | 12:00:00 AM | | 0 | |
| ACCUMULATOR NEW PAGE | 30 | 14/2000 5:12:24 PM | 12:00:00 AM | | 0 | |
| COLLECTOR COUNT ERROR | 32 | 14/2000 5:12:14 PM | 12:00:00 AM | | 0 | |
| COLLECTOR DUMP ERROR | 35 | 14/2000 5:10:25 PM | 12:00:00 AM | | 0 | |
| CARRIER MISS | 8 | 11/2000 9:07:51PM | 12:00:00 AM | | 0 | |
| CARRIER MISS | 8 | 11/2000 9:05:00 PM | 12:00:00 AM | | 0 | |
| CARRIER MISS | 8 | 11/2000 5:05:15 PM | 12:00:00 AM | | 0 | |
| ALERT | 44 | 11/2000 4:59:57 PM | 12:00:00 AM | | 0 | |
| CARRIER MISS | 8 | 11/2000 4:58:52 PM | 12:00:00 AM | | 0 | |
| ACCUMULATOR NEW PAGE | 30 | 11/2000 4:48:21 PM | 12:00:00 AM | | 0 | |
| ACCUMULATOR ERROR | 25 | 11/2000 4:44:09 PM | 12:00:00 AM | Sta Sel Opt3 | 0 | Page C |
| ACCUMULATOR NEW PAGE | 30 | 11/2000 4:35:58 PM | 12:00:00 AM | Sta Sel Opt3 | 0 | Page C |
| CARRIER MISS | 8 | 11/2000 4:20:55 PM | 12:00:00 AM | Sta Sel Opt3 | 0 | Page C |
| ACCUMULATOR NEW PAGE | 30 | 11/2000 4:19:41 PM | 12:00:00 AM | | 0 | |
| COLLECTOR DUMP ERROR | 35 | 11/2000 4:19:38 PM | 12:00:00 AM | | 0 | |

OK [F-1]

*Fig. 3K*

REAL-TIME INTELLIGENT PACKET-COLLATION SYSTEMS AND METHODS

CROSS REFERENCE TO RELATED APPLICATIONS

This application is a continuation-in-part of U.S. patent application Ser. No. 10/036,653, now U.S. Pat. No. 6,670,569, entitled "MAIL HANDLING EQUIPMENT AND METHODS," filed Nov. 8, 2001 by Scott J. Smith et al., the entire disclosures of both of which are herein incorporated by reference.

BACKGROUND OF THE INVENTION

This application relates generally to systems and methods for inserting mail materials into mailing envelopes. More particularly, this applications relates to systems and methods that tailor the collation of mail materials for insertion into envelopes according to criteria for items on an individual mailing unit.

Many different types of organizations have a general need for high-volume mailing operations so that they may issue items periodically to customers, such as billing statements or the like. It is typically desirable to include inserts with the items to provide information and/or advertising to the customers. The mail-processing facilities currently used to prepare such items with their inserts usually include several systems that perform different functions in the overall process. One such system is used, after items have been printed and folded, to insert the items together with the informative and advertising inserts into envelopes with an inserter. Subsequently, the envelopes are sealed, metered with postage, and mailed out to the customers.

Inserters are generally configured with a conveyor belt along which the item is conveyed to the envelope. At different stations along the conveyor belt, inserts may be stacked with the item from hoppers so that when the item reaches a station for envelope insertion, it is accompanied by the inserts. In other inserter configurations, the envelope is moved along the conveyor belt with the items and inserts being added individually at the hopper stations rather than collectively at the end. In either case, suction or vacuum elements are used to hold the envelopes open for insertion. This may be done by lowering suction cups onto an upper surface of the envelope, applying a vacuum to lift the upper surface of the envelope to open it and thereby ready it to accept insertion of the assembled materials. Following insertion, the vacuum is removed to allow the filled envelope to proceed to subsequent processing steps of sealing and metering. One example of an inserter is described in U.S. Pat. No. 5,125,214, the entire disclosure of which is herein incorporated by reference for all purposes.

Such a conventional inserter arrangement is limited in versatility since each run of a batch of mail items includes the same inserts for all of the items. There is a general need in the art for improved systems that permit individual selection of inserts for each of the mail items, even during a single batch run.

BRIEF SUMMARY OF THE INVENTION

Embodiments of the invention achieve improved versatility by using a job file from which information is extracted to control operation of an inserter. A job file is used broadly herein to refer to any type of electronically stored information regarding how individual mailing units are assembled, and may include text files, database files, or other types of files. The job file may specify various parameters that determine, individually, how each mail item in a given run of the inserter is to be processed by the inserter. One advantage of such a job file is that it may be modified to change instructions up until the time the job is run. In some instances, the job file is provided by a customer over a dedicated line to a control computer, although in other embodiments it may be provided over the internet.

An inserter suitable for use with embodiments of the invention includes a plurality of hoppers from which inserts may be selected to include with a mail item. The mail item is moved sequentially, such as with a conveyor, to positions that correspond with the plurality of hoppers. At each position for the mail item, information extracted from the job file related to how that mail item is to be processed is used to determine whether the insert from the corresponding hopper should be included with the mail item. If so, the hopper is caused to include the insert with the mail item; otherwise, the mail item is permitted to proceed to the next position without the insert being included. The information may be extracted from the job file by reading an identification from the mail item, such as from a bar code imprinted on the mail item, and by cross referencing the identification with an entry in the job file.

The information extracted from the job file may include other processing instructions that control such aspects of the inserter operation as whether to seal the envelope after filling it with the mail item and any inserts, whether to meter the envelope and perhaps by which of a plurality of meters, whether to direct the envelope along a main output conveyor or along a divert conveyor, and whether to apply zip markers to the envelope. In each instance, those aspects of the operation are performed in accordance with the information from the job file.

Embodiments of the invention may also include an operator display that may be used by an operator to monitor the operation of the inserter and to take corrective action if necessary. The operator display may have a variety of different views accessible by the operator. One such view provides an image of the inserts loaded in the hoppers, and the operator may reassign the inserts among the hoppers by using the display interface. Another view provides a track display having elements that correspond to the positions the mail item may take on the inserter. Activation of one of those elements provides data about the particular mail item that is at that position. In still another view of the display, the operator may enter override information for any of the actions to be taken by the inserter so that it will perform the override function rather that follow the instruction derived from the job-file information.

The methods described above may also be embodied in a computer-readable storage medium having a computer-readable program embodied therein for directing operation of the inserter. The program includes instructions to effect the methods described.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. In some instances, a sublabel is associated with a reference numeral and follows a hyphen to denote one of multiple similar components. When reference is made to a reference numeral without specification to an existing sublabel, it is intended to refer to all such multiple similar components.

FIGS. 3A–3K provide screen views of a display generated by a program configured in accordance with an embodiment.

DETAILED DESCRIPTION OF THE INVENTION

According to embodiments of the invention, an inserter control system is provided in which specific inserts may be included on an individual basis with mail items. In general operation, the hoppers of an inserter are filled with the various inserts that may be included with the mail items in a specific batch run of the inserter. As the mail items proceed through the inserter, a controller operates in accordance with instructions received from a control computer to determine whether to include specific ones of the inserts from the hoppers. These instructions are derived from a job file. Examples of types of inserters that may be used with embodiments of the invention, among others, include those described in U.S. patent application Ser. Nos. 10/045,589, entitled "SYSTEM AND METHODS OF PROVIDING INSERTS INTO ENVELOPES," filed Nov. 8, 2001 by Bruce A. Bennett et al. and 10/036,653, now U.S. Pat. No. 6,670,569, entitled "MAIL HANDLING EQUIPMENT AND METHODS," filed Nov. 8, 2001 by Scott J. Smith et al., the entire disclosures of both of which are herein incorporated by reference.

Figure 1A:
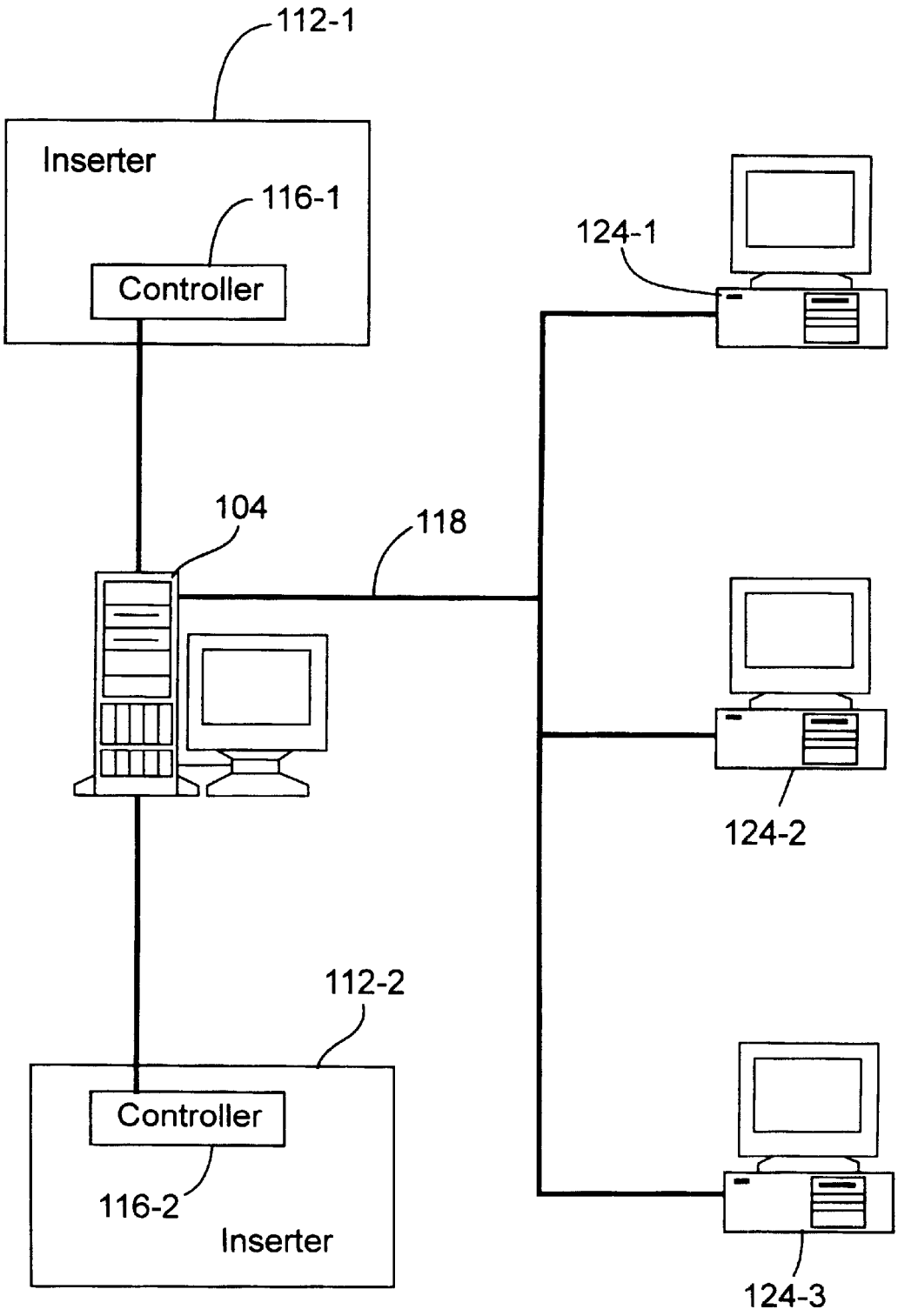
FIGS. 1A and 1B provide schematic illustrations of embodiments that permit a job file containing insert information to be obtained from a customer.

FIG. 1A provides a schematic overview of one embodiment of a such an inserter control system as operated by a control computer 104. In the illustrated embodiment, the control computer 104 is connected with controllers 116 of a plurality of inserters 112, although it may alternatively be configured only for control of only a single inserter. In one embodiment, the controllers 116 comprise PLCs. The control computer 104 may be connected with a network arrangement 118 of dedicated lines to a plurality of customer computers 124. Inserter-control instructions are provided to the control computer 104 from each of the customer computers 124 in the form of a job file as described below. Accordingly, the illustrated embodiment shows a configuration in which the inserters 112 under the control of the control computer 104 may be used to perform insertion batch runs for different customers, each of which may have different requirements.

Figure 1B:
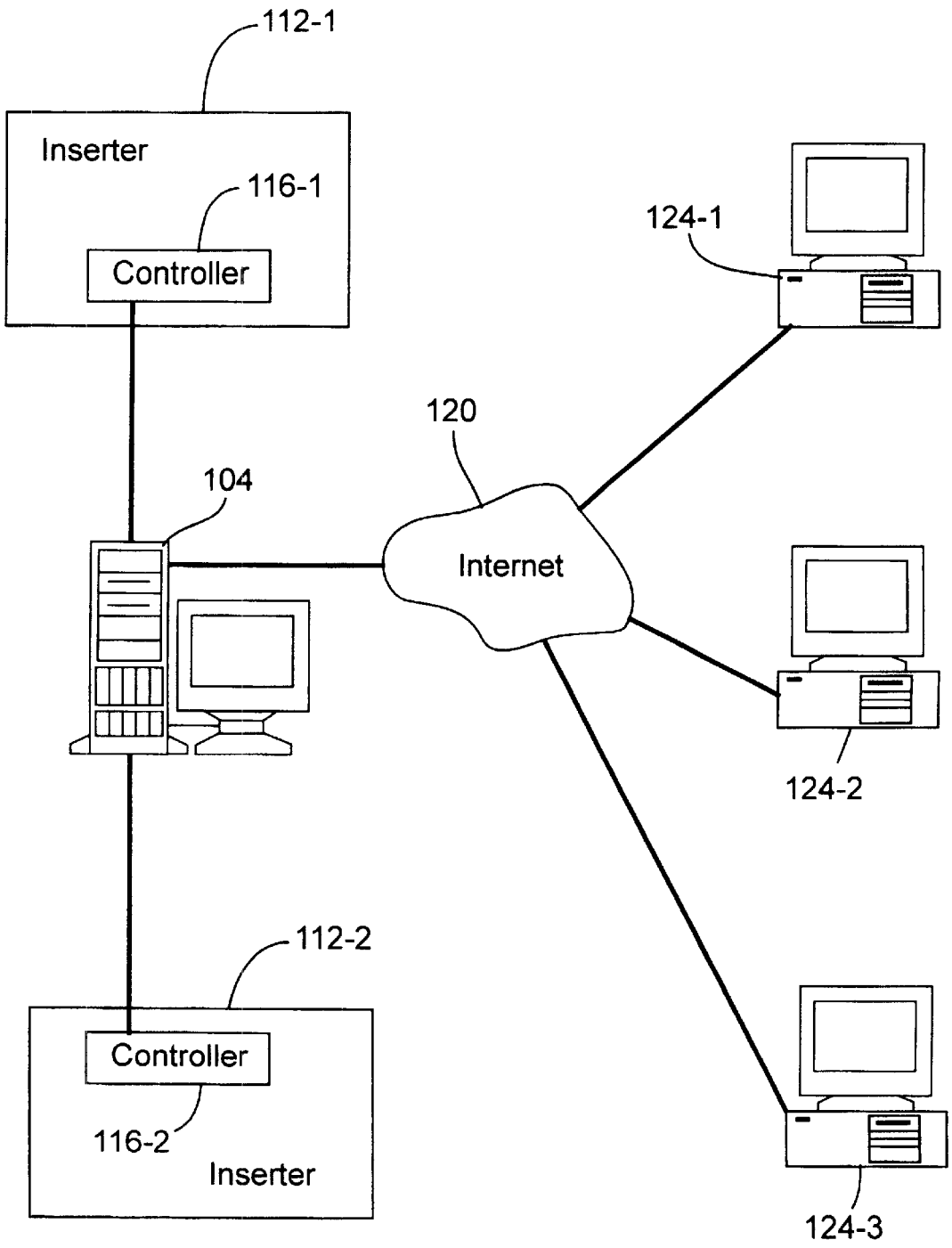

An alternative arrangement that makes use of the internet 120 is illustrated in FIG. 1B. In this embodiment, the control computer 104 is also connected with controllers 116 of a plurality of inserters 112, but is connected with the internet 120 instead of to a network arrangement of dedicated lines. Each of the customer computers 124 is also connected to the internet 120 so that communication of the inserter-control instructions in the job file may be provided to the control computer 104 with transmissions over the internet 120. Still other configurations will be apparent to those of skill in the art that permit the job file to be provided to the control computer 104. For example, while the internet connections shown in FIG. 1B are direct connections for both the control computer 104 and the customer computers 124, a tandem computer may alternatively by included. In still other embodiments, the job file may reside on a portable storage medium that may be physically transported to the control computer 104.

The different customer requirements may be embodied by different types of mail items used by customers that are to be processed by the inserter system. For example, in one embodiment, one of the customers provides paper statements on a periodic basis for mailing to its own customers. Such paper statements may include credit-card statements, utility bills, mutual-fund reports, or any other type of periodic or nonperiodic statement. In another embodiment, one of the customers provides plastic cards to be mailed to its customers. Such plastic cards may include credit cards, ATM cards, loyalty-program cards, or any other type of plastic card that the customer wishes to provide to its own customers. More generally, embodiments of the invention are capable of accommodating any type of mail item that may be processed by a suitable inserter and for which a customer wishes to individualize the inclusion of inserts with the mail item.

To use the mail-insertion facilities, a given customer provides the control computer 104 with a job file that specifies the necessary information to execute the insertion. This information may include, among other criteria, which inserts to include with each of the individual mail items, whether or not to seal the envelope, how much postage to apply to each envelope, whether a given mail item should be automatically mailed after processing or sorted for special handling, and whether to print a zip marker on the envelope for identification. The job file may be generated by the customer using software that resides on the customer's computer 124. Any format may be used for the job file provided it is consistent with a format used by software on the control computer 104 to control one of the inserters 112 in completing the job. Within the file, an identification is provided that corresponds uniquely to each of the individual mail items. This identification is used as described below to extract the handling information for that item from the file and may correspond, for example, to a bar code printed on the item or any other accessible unique identification.

Figure 2A:
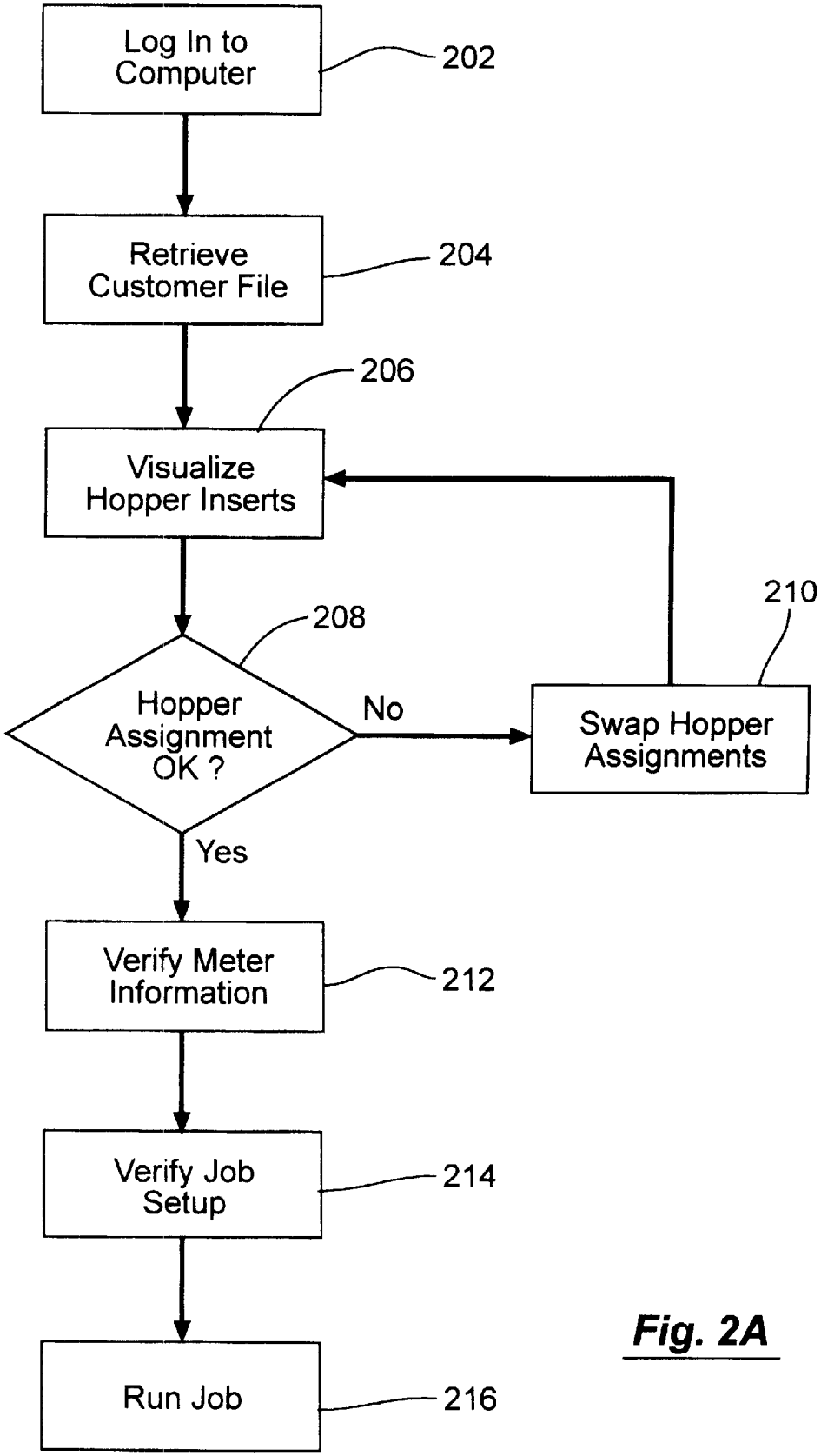
FIG. 2A provides a flow diagram of functions performed by an operator with inserter software configured in accordance with an embodiment.

FIG. 2A provides a flow diagram illustrating steps taken by an operator of the control computer 104 to run an insertion job for a customer. In some instances, the description of this flow diagram below makes reference to screen views that may be shown to the operator on a display at different points in the process; such exemplary screen views are provided in the referenced portions of FIGS. 3A–3K. The exemplary screen views correspond to an embodiment in which six hoppers and two postal meters are used, but other embodiments may, of course, use different numbers of hoppers and postal meters.

Figure 3A:
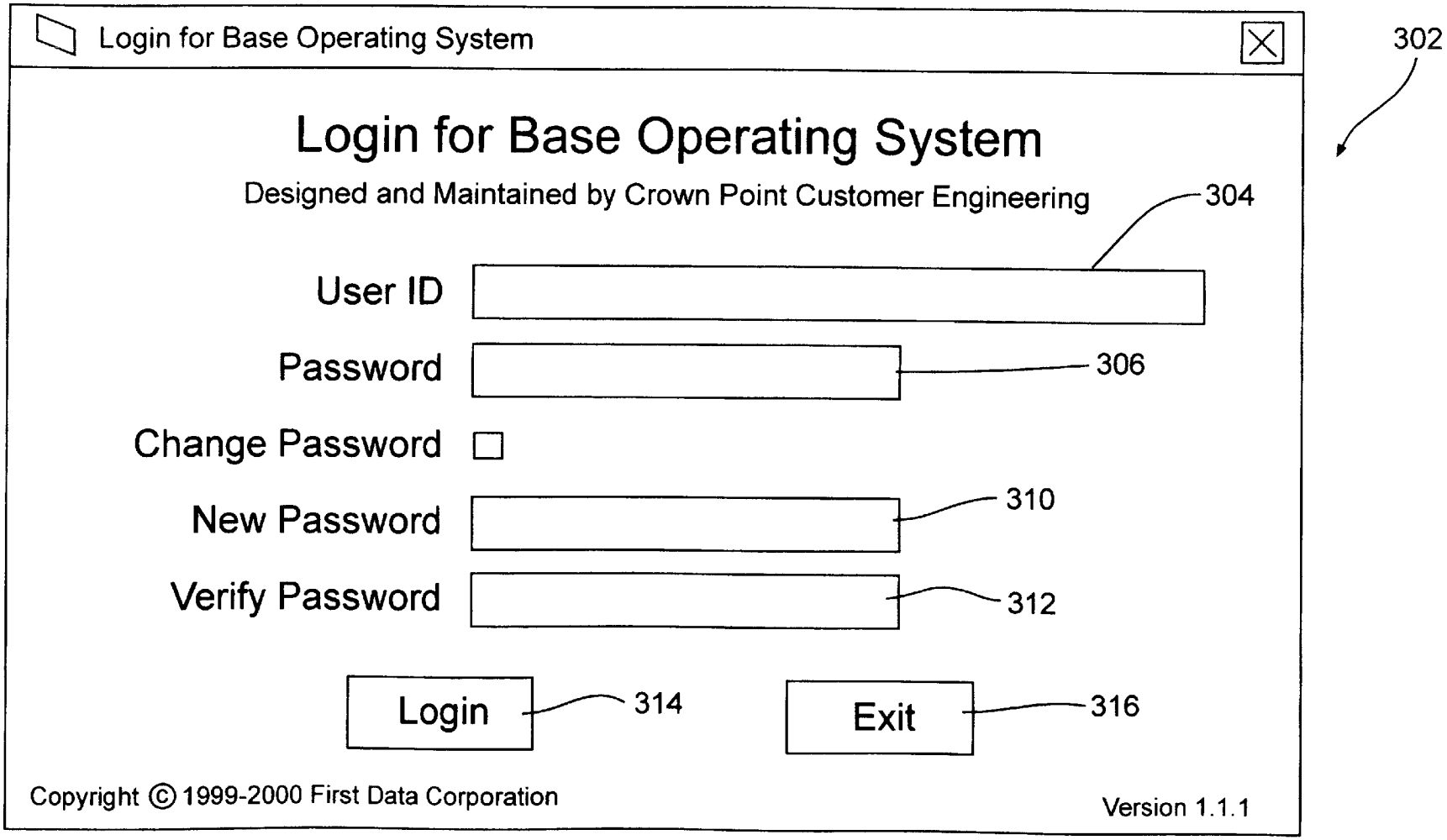

Thus, when an operator is prepared to run the insertion job, (s)he first logs into the control computer at block 202 from a login screen 302 such as shown in FIG. 3A. In addition to fields 304 and 306 for entering the operator's user ID and password, additional fields may be provided to indicate a change in password 308, a new password 310 and a verification of the new password 312. A login button 314 or exit button 316 is clicked to log on to the system or exit from it respectively.

Figure 3B:
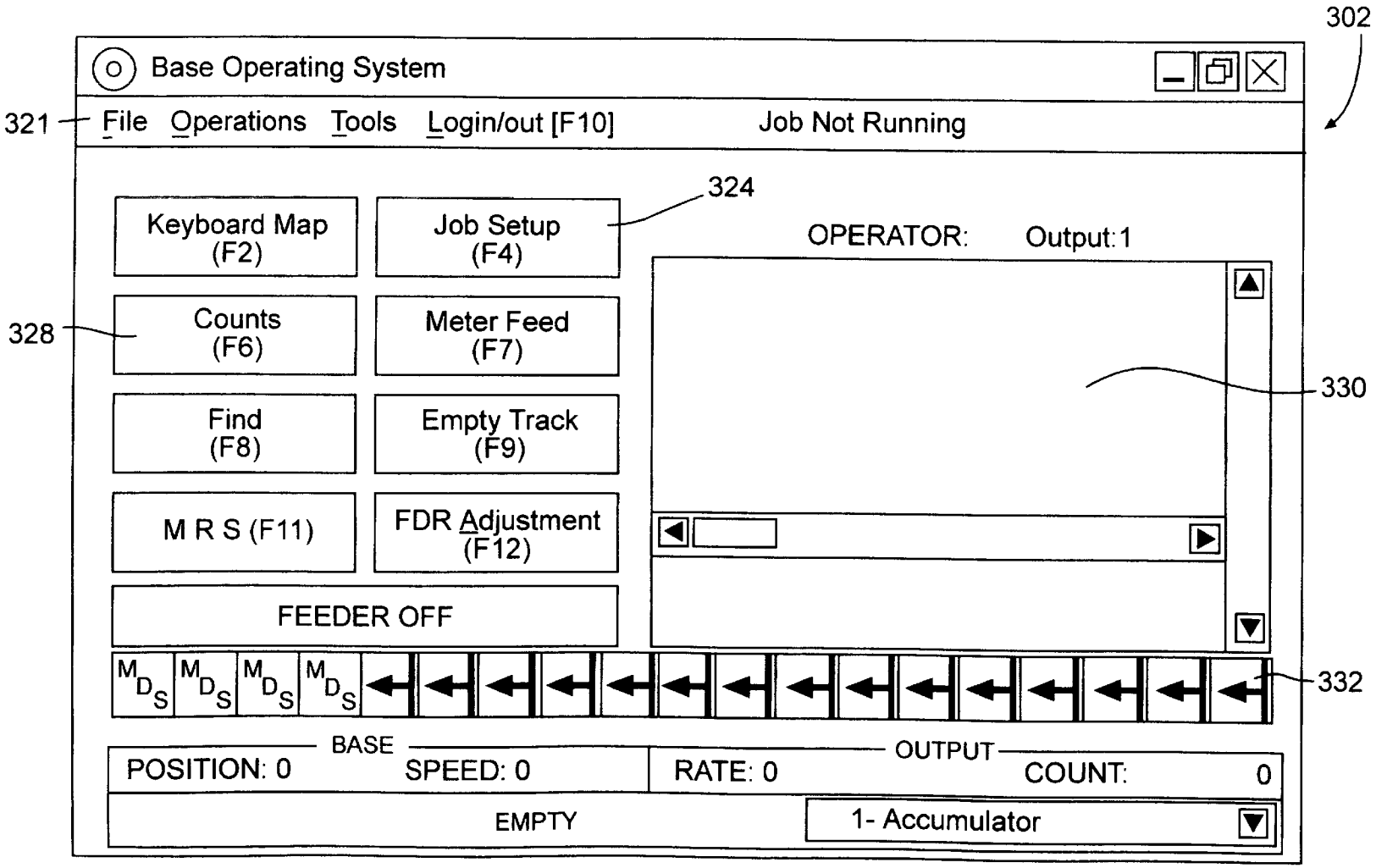

Once the operator has logged into the system, (s)he may be presented with a principal running screen 320 such as the one illustrated in FIG. 3B. This screen 320 is a basis point for operation of the system and provides access to a variety of functions that may be used by the operator. Generally, such functions will be accessed from a menu bar 321 that uses drop-down menus, although certain commonly used functions may be accessed by buttons on the screen. Examples of such buttons include the "Job Setup" button 324 and the "Counts" button 328, among others. Displays 330 and 332 are used when a job is running, as discussed with respect to FIG. 3I below. It is noted that in some embodiments access to certain functions may be restricted to certain types of personnel, such as supervisory personnel or technical personnel.

Figure 3C:
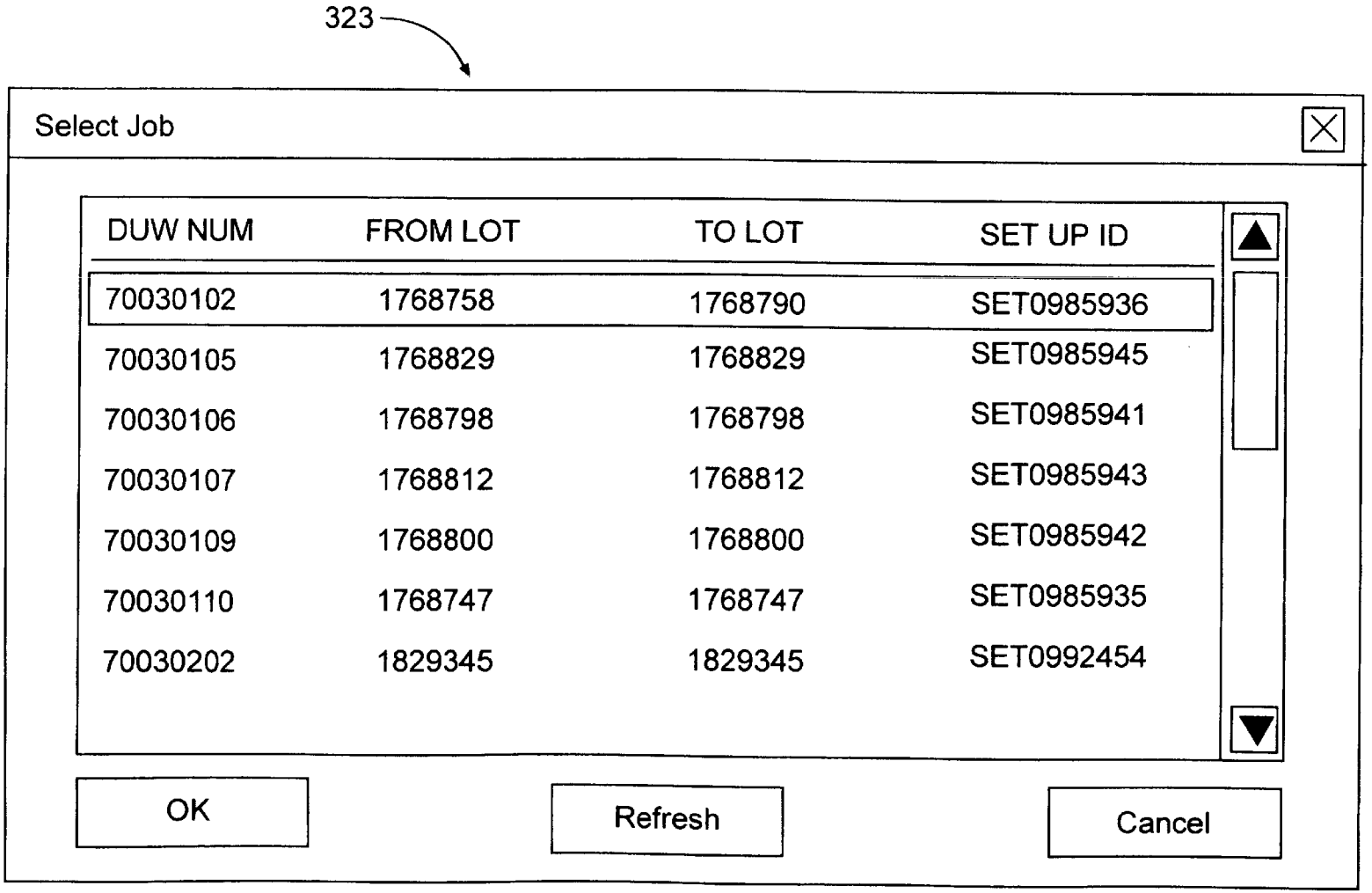

At block 204 of the flow diagram of FIG. 2A, the operator retrieves the desired customer file corresponding to the insertion job. This may be done by using the drop-down menus of the principal running screen 320 to choose a "Select Job" function, thereby causing presentation of a list 323 of the available job files such as shown in FIG. 3C. The desired file is selected by using cursor or mouse controls to select the line having the correct identifying information and clicking "OK."

Figure 3D:
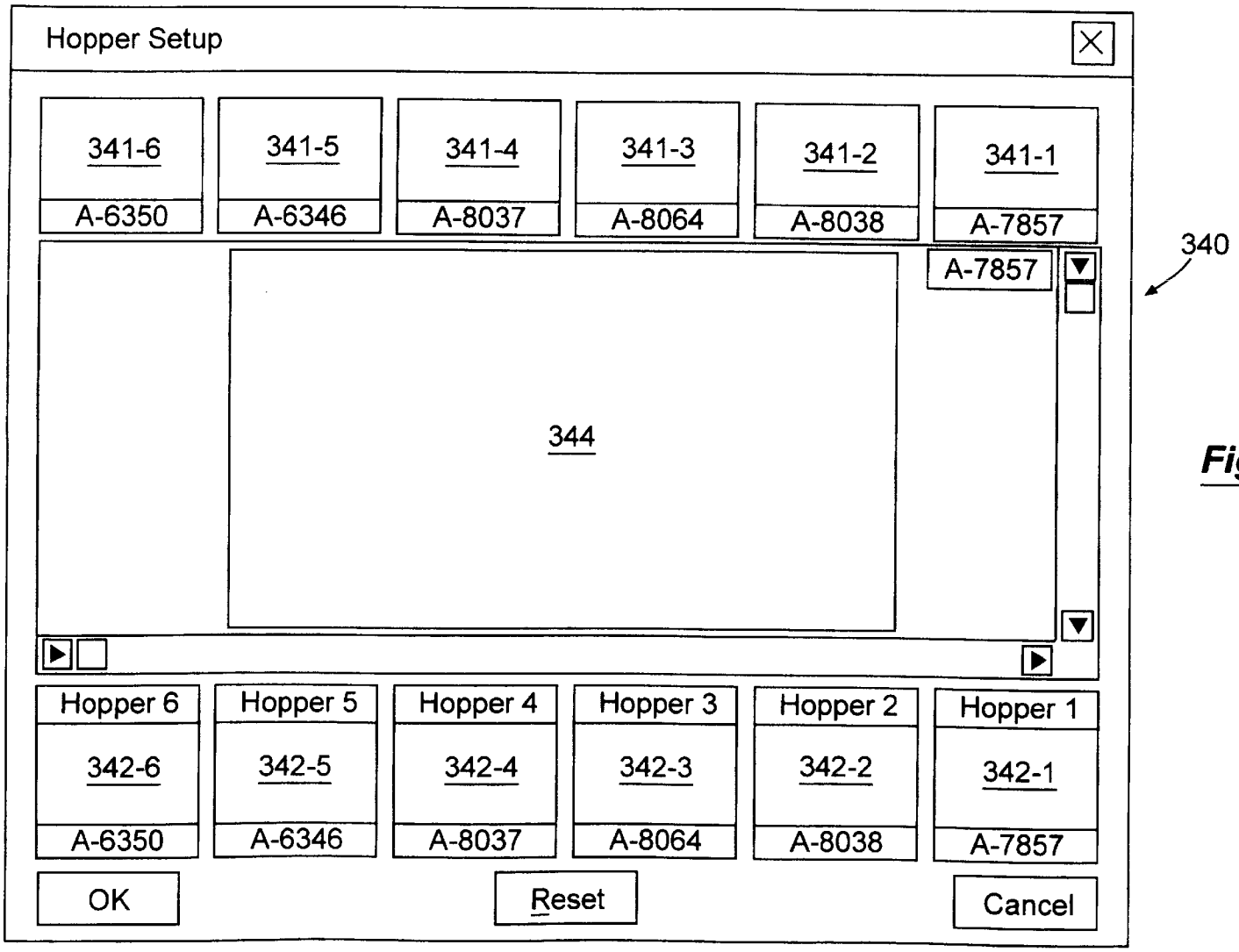

Subsequent blocks in the flow diagram of FIG. 2A permit the operator to change certain setup information from the control computer 104 to customize the job. In some instances, this setup information is defined initially by parameters specified in the retrieved job file. At block 206, for example, the operator may choose to visualize the hopper insert assignments by using the drop-down menus to select "Operations—Hopper Setup" from the principal running screen 320. A view 340 of the inserts such as shown in FIG. 3D may then be provided for the visualization. In the embodiment shown, the top row of the view 340 includes a plurality of thumbnail images 341 of the inserts according to their current hopper assignments. A more detailed view of a particular image may be seen in the large central image area 344 by clicking on any of the thumbnail images 341.

At block 208 of FIG. 2, the operator determines whether the existing hopper assignment is acceptable. If not, (s)he may reassign hopper assignments at block 210 for any insert having its image shown in the central image area 344 by subsequently clicking on the lower row of hopper assignments 342. Such a reassignment of hopper inserts should generally correspond to how the inserts are distributed on the actual inserter 112 to be used for running the job. In one embodiment, reassignment of hopper inserts requires authorization by supervisory personnel.

Figure 3E:
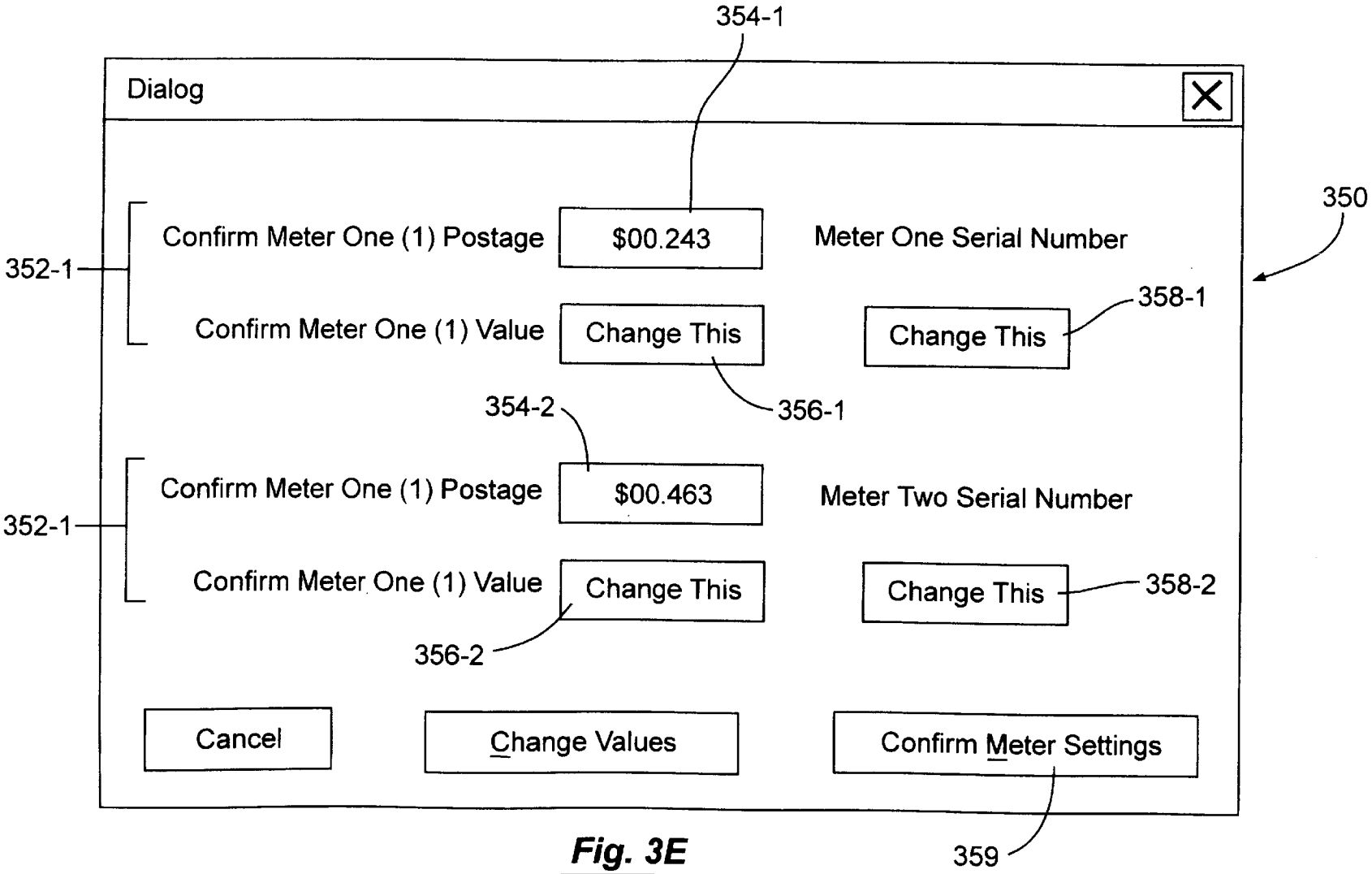

At block 212, after the operator verifies the hopper assignment information, (s)he may verify the postal meter information. This is done with a screen 350 such as shown in FIG. 3E, which may be displayed by the system automatically upon verifying the hopper assignment or may be accessed as desired from the principal running screen 320. The screen 350 may include fields 352 providing information for a plurality of postal meters to which individual envelopes may be directed. For each postal meter, the individual item postage 354 is specified, as may be the serial number for the postal meter. In the example shown, the first postal meter is set to stamp envelopes with 24.3 ¢ postage and the second postal meter is set to stamp envelopes with 46.3 ¢ postage. Change buttons 356 and 358 may be used to change the values and serial numbers, which are then confirmed by clicking the "Confirm Meter Settings" button 359. In one embodiment, a change of meter settings requires authorization by supervisory personnel.

Figure 3F:
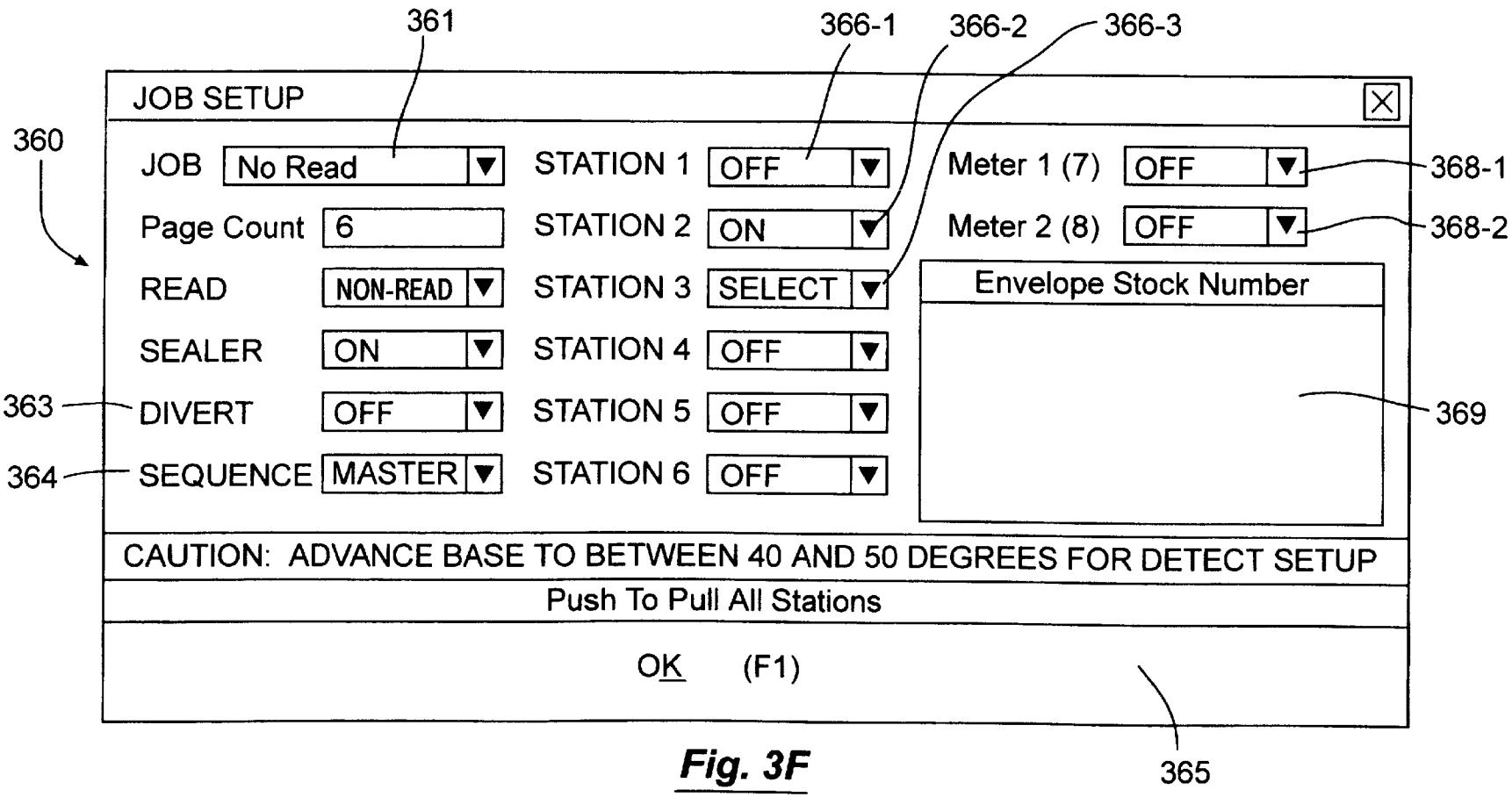

After verifying the meter information, the job setup information is verified at block 214. Such job setup information is verified using a job-setup screen 360 such as shown in FIG. 3F. In different embodiments, the system may force this screen to be viewed after verifying the meter information or it may be reached from the principal running screen 320 by clicking the "Job Setup" button 324 or by using the drop-down menus to select "Operations—Job Setup." The options provided by the job setup screen 360 optionally permit the inserter to be run in a "standard" mode, in which a number of parameters for a particular job are fixed, or in an "intelligent" mode, in which such parameters are treated as options determined individually for each mail item according to the job file. Various of these parameters are discussed below for a specific embodiment, although it will be understood that different parameters may apply in alternative embodiments. In one embodiment, a change in job setup information requires authorization by supervisory personnel The "JOB" field 361 is used to specify whether a bar code should be read off of each of the mail items at a feeder to the inserter 112. In standard mode, the field may be "off" to indicate that every mail item should be treated in exactly the same way so that any such bar code is irrelevant to the operation. In the intelligent mode, the "JOB" field 361 will generally indicate that the bar codes should be read from each mail item, permitting retrieval of an identification code used for correlation with the instructions in the job file.

The "SEALER" field 363 is used to indicate whether envelopes should be sealed by the inserter. There are generally three options. First, the field 363 may be set to "SELECT," which is used in intelligent mode to cause the inserter to use the sealing instructions provided in the job file. Second, the field 363 may be set to "ON," which will cause the inserter to seal all envelopes; this is true both in standard mode and in intelligent mode, where the field value overrides any designation included in the job file. Third, the field 363 may be set to "OFF," which will cause the inserter to leave all envelopes unsealed; this is also true both in standard mode and in intelligent mode, where the field value overrides any designation included in the job file.

The "DIVERT" field 364 operates similarly, but specifies whether envelopes should continue along the main output conveyor of the inserter 112 or should be redirected to a divert conveyor. Diverted envelopes may be collected for special handling. Setting the field 364 to "ON" or "OFF" respectively causes all envelopes to be directed along the main output conveyor or to the divert conveyor in both standard and intelligent modes, with the setting acting as an override of any instructions in the job file when used in intelligent mode. Setting the field 364 to "SELECT" in intelligent mode will cause the inserter 112, under the control of the controller 116, to follow the individual instructions for each mail item set forth in the job file. In some instances, it may be desirable to sort the envelopes according to the instructions in the job file, but to reverse the uses of the main and divert conveyors to accommodate the physical layout of the inserter 112. Such processing may be achieved with an additional setting for the field 364, "SWAP SELECT," that causes execution of the opposite to the job-file instructions. With such a setting, envelopes instructed by the job file to divert are directed along the main conveyor, and envelopes directed not to divert by the job file are directed to the divert conveyor.

In the second column of the job-setup screen 360, fields 366 are provided for each of the hopper stations that may be set by the operator as desired to "ON," "OFF," or "SELECT." These field values are similar to those discussed above. In intelligent mode, a setting of the field value to "SELECT" causes the inserter 112, under the control of the controller 116, to pull the insert at that hopper or not according to the instructions in the job file. Setting the hopper field 366 values to "ON" or "OFF" cause the inserter 112 respectively always to pull or always not to pull inserts from the associated hoppers. Such settings define the uniform operation in standard mode and act to override the job-file instructions, if desired, in intelligent mode.

In the right column of the job-setup screen 360, fields 368 are provided for each of the postal meters that may be used for metering envelopes. As for other fields, the meter field 368 may be set by the operator as desired to "ON," "OFF," or "SELECT." A setting of "SELECT" is used in intelligent mode to indicate that the job-file instructions should be followed for using a particular postal meter for metering individual envelopes. Such settings can be overridden in intelligent mode by using the "ON" and "OFF" settings respectively to indicate that a particular meter should or should not stamp every envelope. The "ON" and "OFF" settings are also used in standard mode to define the uniform operation of the meters. Generally, the system is configured so that only one meter field 368 may be set to "ON" at a time; setting any one of the meter fields 368 to "ON" requires all other meter fields 368 to be set to "SELECT" or "OFF." In one embodiment, the act of setting one of the meter field 368 to "ON" automatically causes all other meter settings to be set to "OFF," although they may subsequently be reset to "SELECT."

Figure 3G:
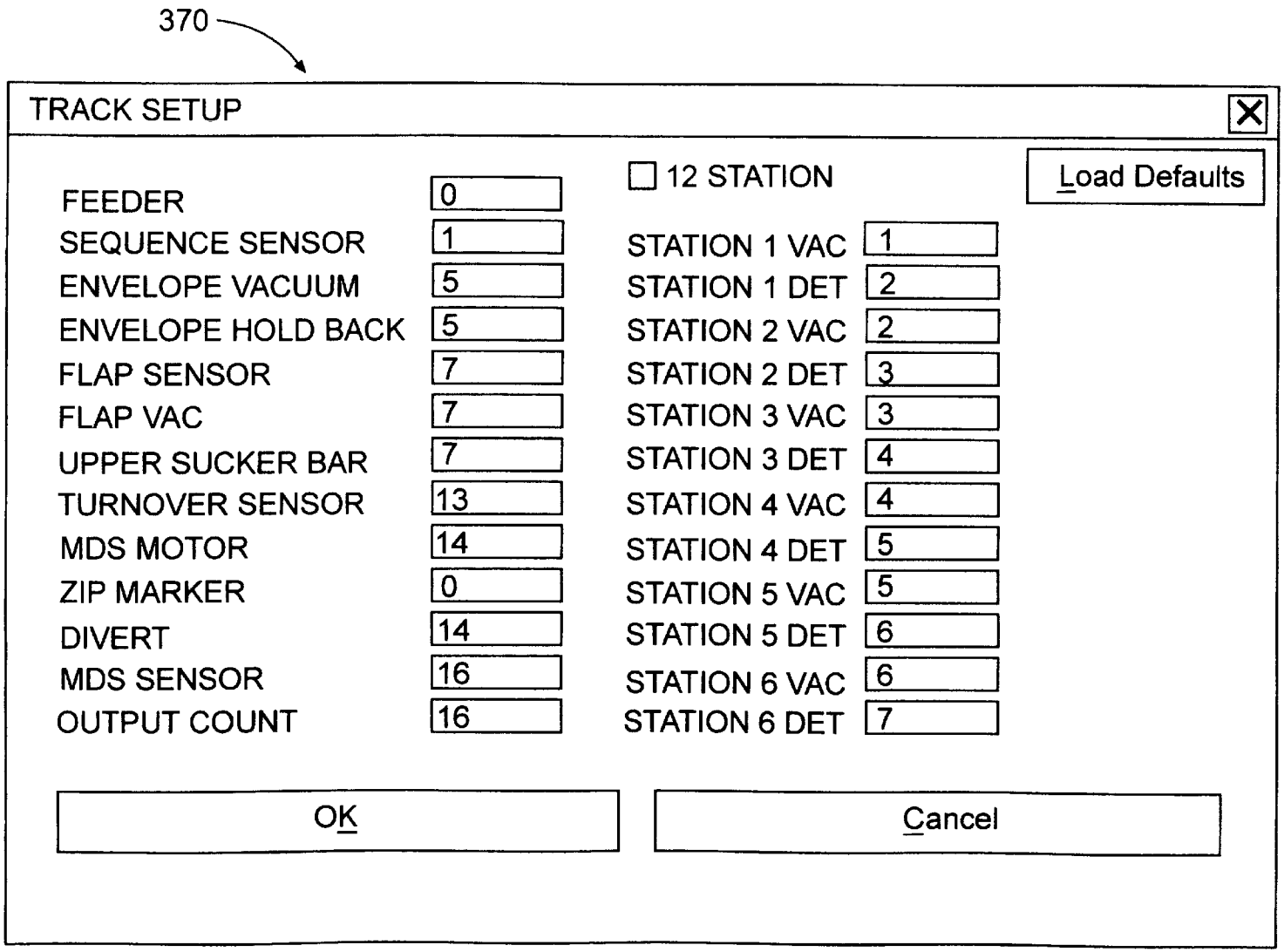
Figure 3H:
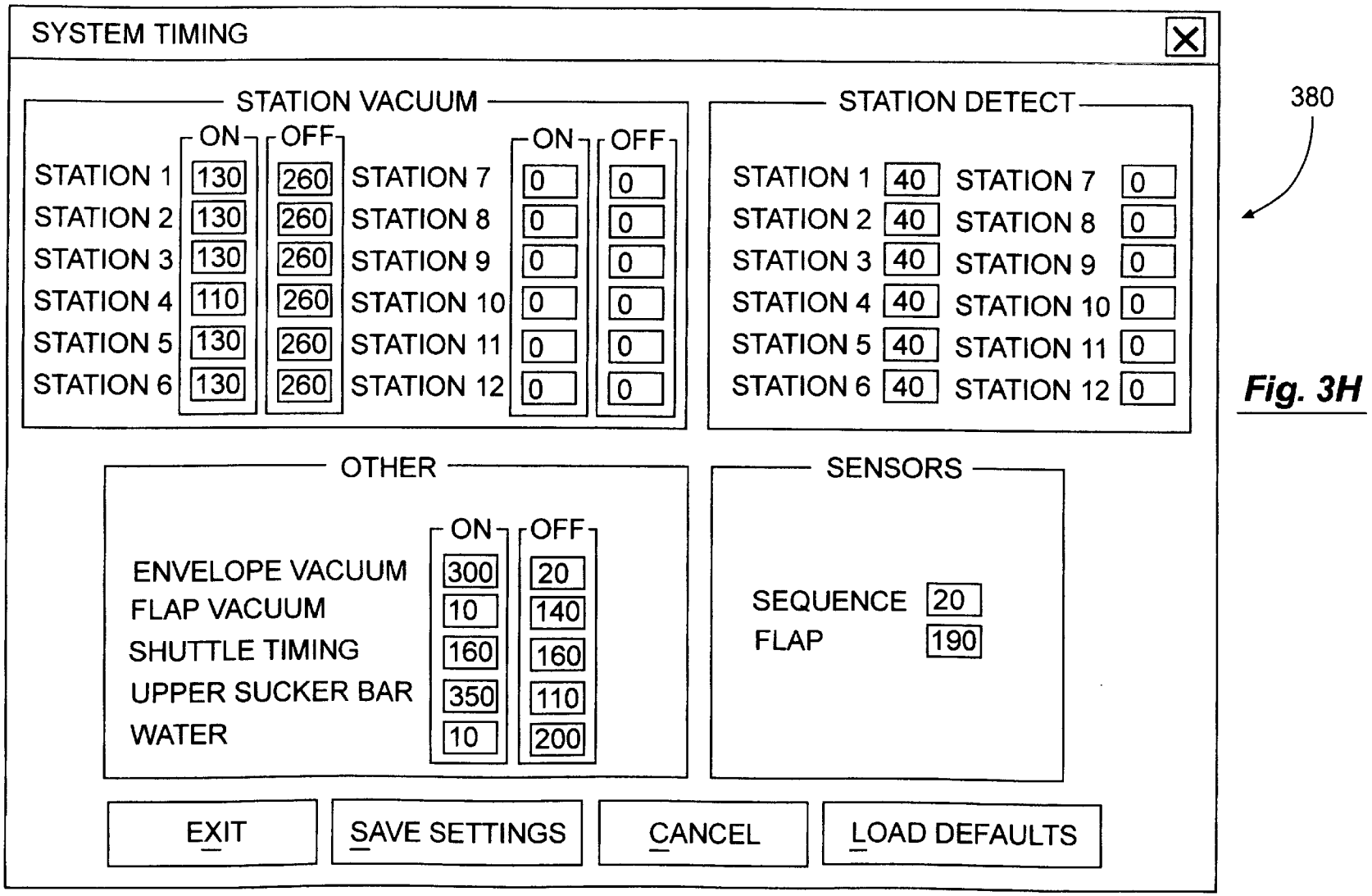
Figure 3I:
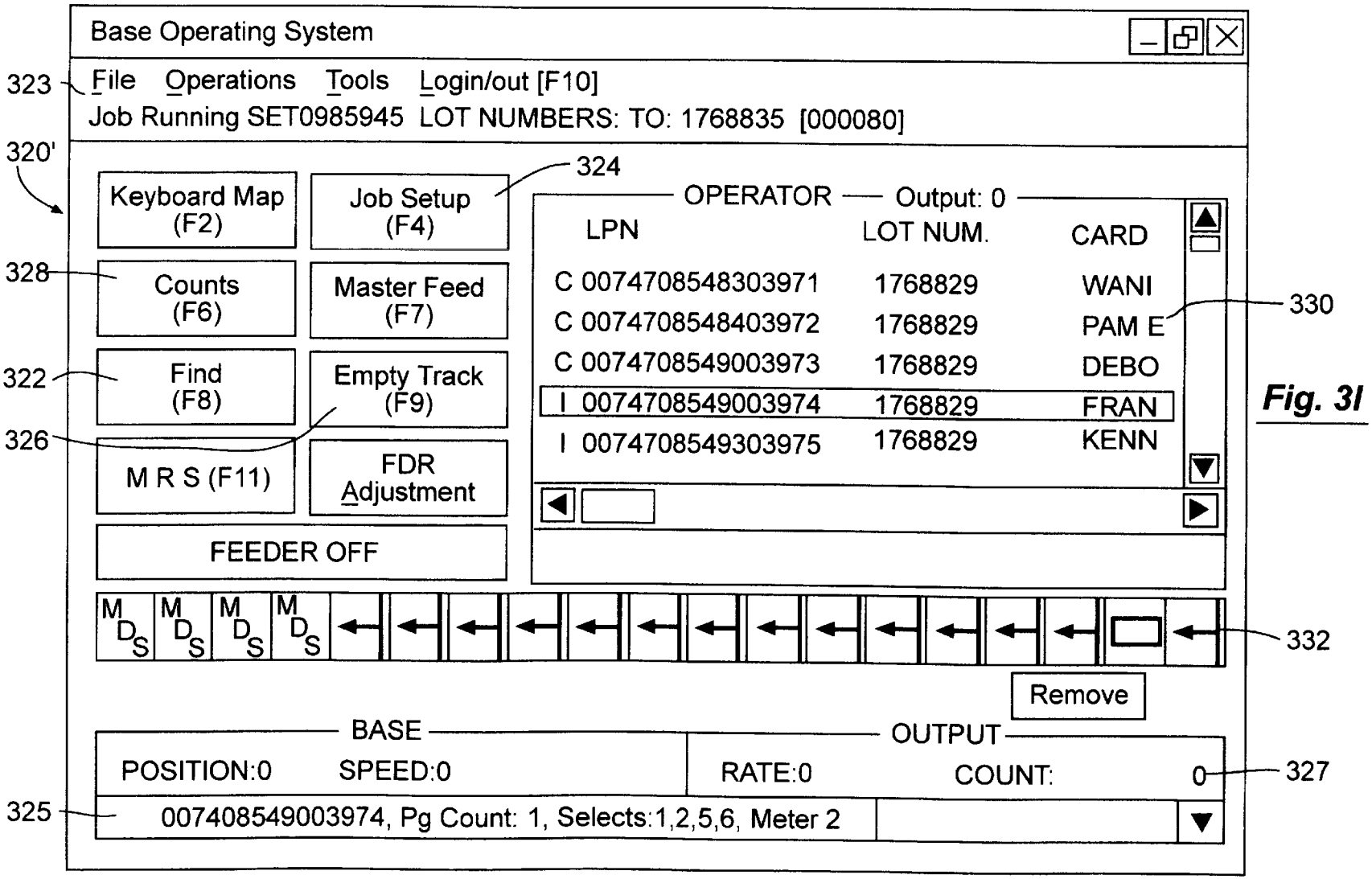

Once the job-setup parameters have been set as desired, they are approved when the operator clicks the "OK" button 365. FIGS. 3G–3I provide screen views of additional setup screens that may be accessed from the principal running screen 320 with the "Tools" drop-down menus. In FIG. 3G, for example, a "Track Setup" screen 370 is shown that permits adjustment of physical parameters for the inserter 112 by changing numerical values associated with such things as the sensitivity of various sensors and the strength of vacuums used at different stations, among other parameters. These parameters will generally have default settings, but may be adjusted to accommodate changes in operation that may result from the maintenance level or environment of the inserter 112. Similarly, the "System Timing" screen view 380 shown in FIG. 3H may be used to define positions at which various stations will turn on and off. Again, default settings are available, but may be appropriately adjusted to accommodate maintenance-level or environmental changes. Various other maintenance functions for the system may additionally be included in other embodiments. In one embodiment, access to such maintenance functions is restricted to maintenance technicians.

Once all the parameters governing operation of the inserter system and/or the mode of operation for a particular job, the job is run at block 216 of FIG. 2A.

Figure 2B:
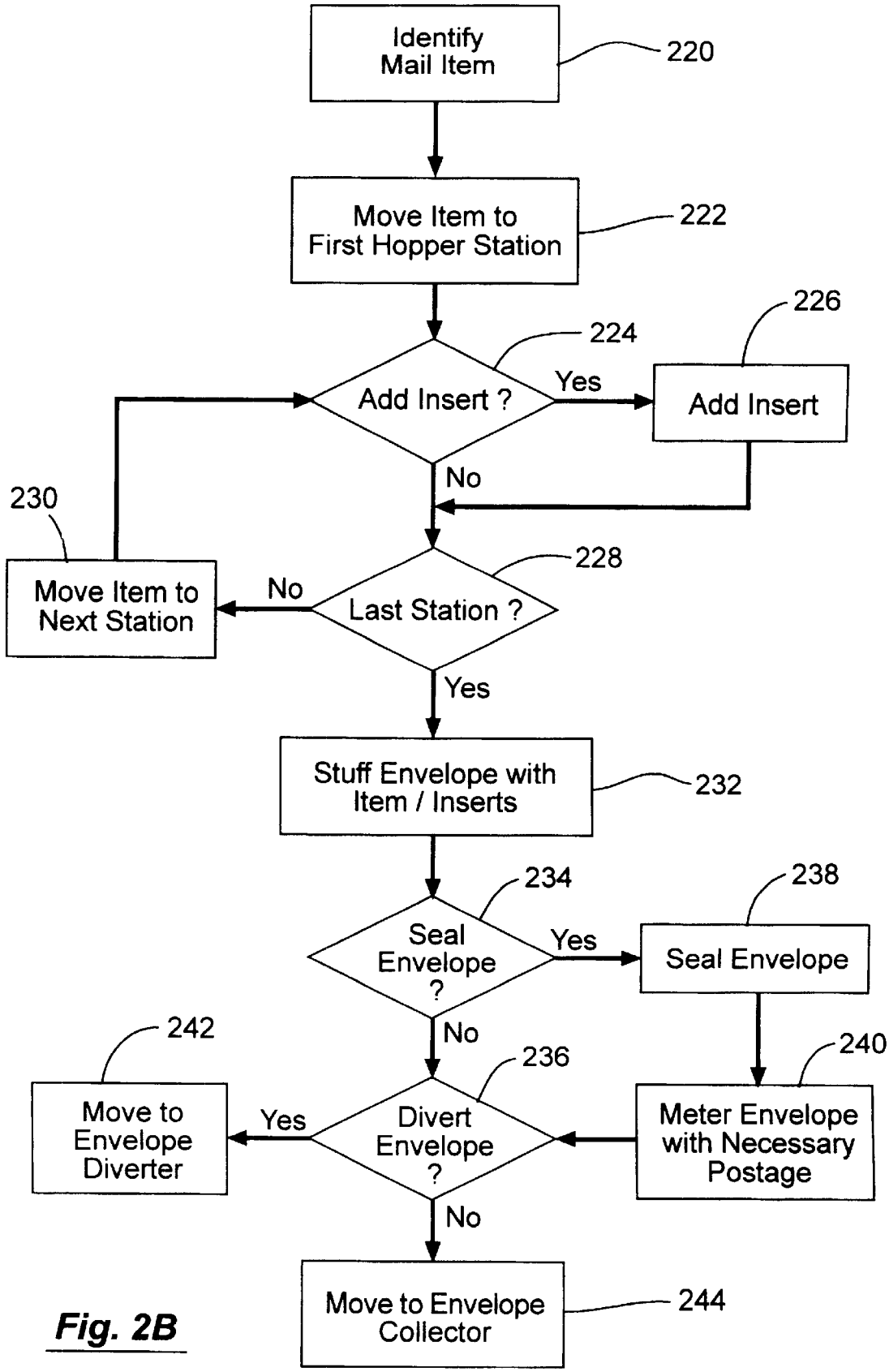
FIG. 2B provides a flow diagram of an insertion operation for a mail item in accordance with an embodiment.

FIG. 2B provides a summary of how the job is actually executed by the system at block 216 for each mail item according to the established job-setup parameters. After an individual mail item is received by the inserter 112, it is identified at block 220 in accordance with the setting in the "JOB" field 361. In one embodiment, this identification uses a bar code printed on the mail item. Where the mail item comprises a paper statement, the bar code will generally be printed directly on the paper statement. Where the mail item comprises a plastic card, the bar code will generally be printed on a paper or cardboard support used to hold the card during mailing. A bar-code scanner comprised by the inserter 112 reads the bar code and transmits the identification to the control computer 104, which completes the identification of the mail item by cross referencing the identification with an entry in the job file.

In intelligent mode, an identifier such as from the bar code on the mail item is read and correlated with the job file to define specific functions in the absence of an override. In standard mode where the "JOB" field 361 does not require the bar code to be read, mail items may be treated according to a default sequence associated with an identifier.

This identification is used throughout the remainder of the job run so that each mail item is treated according to instructions in the job file or according to parameter settings on the job-setup screen 360, depending on whether the job is run in standard or intelligent mode. Thus, at block 222, the first item is moved to the first hopper station and at block 224 a determination is made according to the job mode and parameter settings whether the insert at that hopper station should be added. If so indicated, the insert from that hopper is added with the mail item at block 226. A determination is made at block 228 whether the current hopper station is the last along the inserter conveyor, with the mail item being moved progressively to the next station at block 230. The same functions are performed at each station until the mail item has reached every station and all desired inserts have been added with it.

After leaving the last hopper station, an envelope is filled at block 232 with the mail item and any inserts that have been included as a result of progressing through the series of hopper stations. A determination is made at block 234 whether to seal the envelope in accordance with the job mode and parameter settings, with the envelope being sealed at block 238 and metered at block 240 with any specified meters dictated by that mode and those settings. The required postage and applicable meter may be dictated by the weight of the envelope including the mail item and inserts. In one embodiment, this weight is determined as described in concurrently filed, copending U.S. patent application Ser. No. 10/028,888, entitled "WEIGHT MEASURING SYSTEMS AND METHODS" by Jeffery G. Nowlin et al. (Attorney Docket No. 020375-006500US), the entire disclosure of which is herein incorporated by reference. At block 236, a determination is made whether to divert the envelope in accordance with the mode and settings, causing the envelope to move either along the main output conveyor at block 244 or along the divert conveyor at block 242.

While the job is running, the operator is presented with the principal running screen 320', an example of which is shown in FIG. 3I. This screen is a variant of the screen discussed with respect to FIG. 3B, but includes specific information related to the running of a job. For example, in intelligent mode the top of the screen includes a line 323 that indicates which job is running and display 330 provides summary information about all of the mail items to be processed in that job. A "C" (or other) designation may be used at the far left of display 330 to identify those items whose processing is complete and an "I" (or other) designation may be used at the far left of display 330 to identify those items whose processing is incomplete; different colors may also be used to distinguish the complete and incomplete jobs. The operator may obtain more detailed information regarding how a particular item is to be processed by highlighting the line for that item in display 330, causing a line 325 of detailed information to appear at the bottom of the screen. This detailed information may specify, for example, which inserts are to be included with the mail item, whether the envelope is to be sealed, which postal meters are to be used for metering, and/or whether the envelope is to be diverted.

Similar information may alternatively be obtained from track display 332, which is a schematic illustration on the screen of the conveyor on the inserter. The screen display includes elements that correspond to station locations on the inserter 112. A mouse may be used to position the cursor over one of the track-display elements and thereby pull up the information about the mail item currently at the corresponding inserter station.

Information provided by displays 330 and 332 may also be used by the operator to intervene in the operation of the inserter 112. For example, in the event that the inserter 112 malfunctions, it may be necessary for the operator to suspend its operation temporarily to correct the malfunction. Such correction may include removing certain items from the inserter track, moving them to new locations on the track, or even adding new items. In one embodiment, the right button of a mouse is used to access functions that permit the operator to mark individual items on the display 330 as complete, incomplete, or newly inserted into the track. These functions are used by the operator to configure the record on the principal running screen 320' to correspond with any manual adjustments made to operation of the inserter 112.

For example, suppose an inserter malfunction requires reprocessing of a particular mail item. The operator suspends operation of the inserter, removes the improperly processed item from its position on the track and repositions it at an earlier position where it can be reprocessed. Upon returning to the control computer, the operator uses the mouse functions to mark that item as incomplete and clicks on its new station on the track display 332 to load the information regarding that item at the appropriate position. After completing an update in this fashion, a "refresh" function selected by right-clicking the mouse may be used to display the current status of each item, which should now correspond to their actual status on the inserter. Operation of the inserter is then resumed to complete processing. In the example shown in FIG. 3I, the item at the second station from the right has been removed from processing entirely.

The principal running screen 320' may also include additional information regarding the operation of the inserter. For example, information about the processing efficiency may be provided as shown in display 327. Different types of information may be provided in different embodiments. In the specific example shown in FIG. 3I, the base position and speed indicate the machine cycle position and machine speed in pieces/hour, and the output rate and count indicate the average number of pieces processed per hour and total number of pieces output.

Figure 3J:
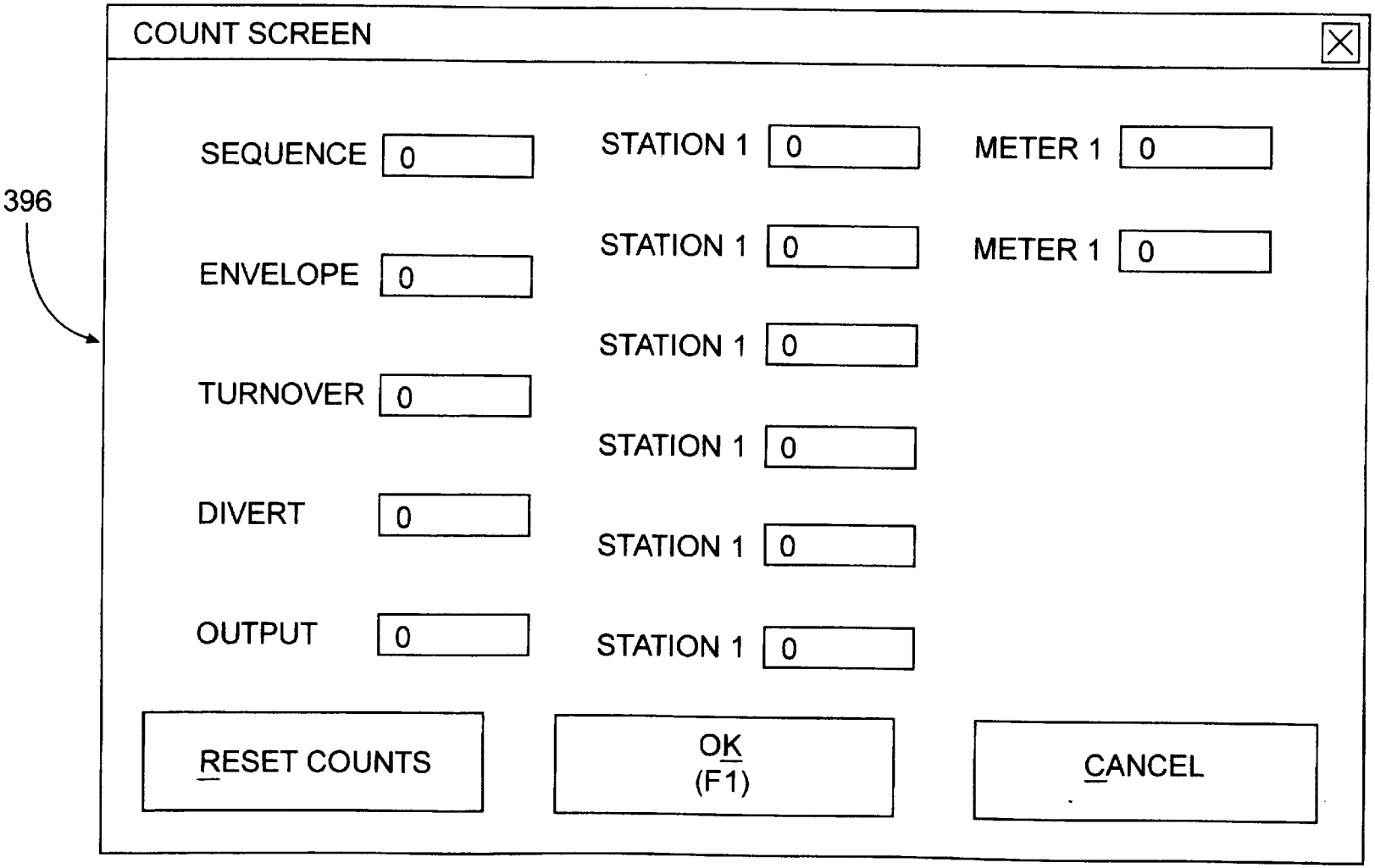

The system may additionally provide other informational screens. For example, more detailed count information may be obtained with a "Count Screen" 396 such as shown in FIG. 3J. This screen provides a count of the number of items processed at each desired station on the inserter, including hopper stations, metering stations, output stations, envelope-sealing stations, divert conveyor stations, and perhaps others. In FIG. 3K, a history of error messages provided by the system may be accessed. This type of information, in addition to others that the system may also be configured to provide, is useful in diagnosing and fixing recurrent problems that may be experienced with the system.

Figure 4:
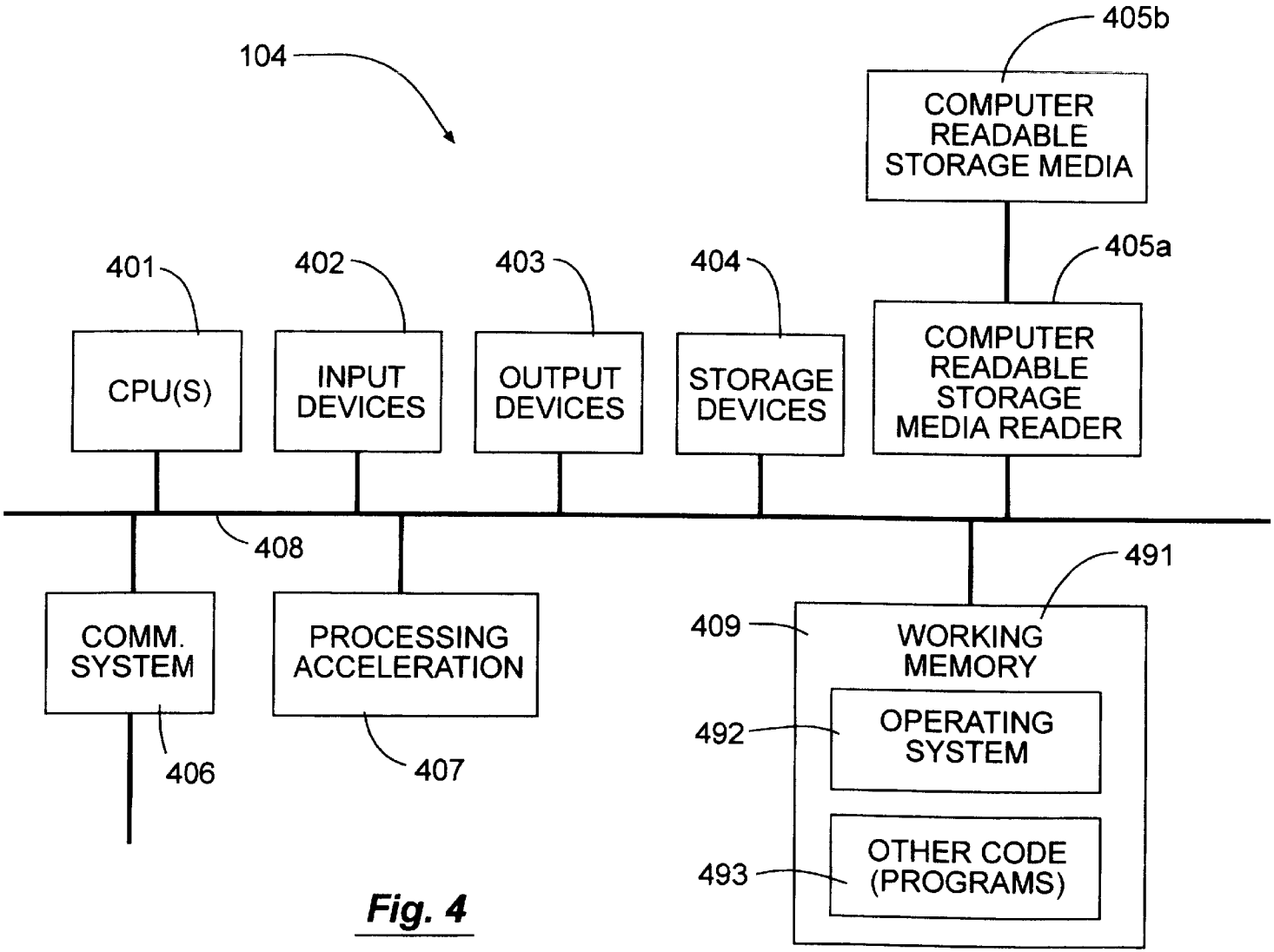
FIG. 4 provides a schematic illustration of a computer system that may be configured to perform inserter-control functions in accordance with embodiments of the invention.

The structure of the control computer 104 is shown schematically for one embodiment in FIG. 4. This figure broadly illustrates how individual system elements for the control computer 104 may be implemented in a separated or more integrated manner. The control computer 104 is shown comprised of hardware elements that are electrically coupled via bus 408, including a processor 401, one or more input devices 402, one or more output devices 403, one or more storage devices 404, a computer-readable storage media reader 405*a*, a communications system 406, a processing acceleration unit 407 such as a DSP or special-purpose processor, and a memory 409. The computer-readable storage media reader 405*a* is further connected to a computer-readable storage medium 405*b*, the combination comprehensively representing remote, local, fixed, and/or removable storage devices plus storage media for temporarily and/or more permanently containing computer-readable information.

The information regarding how individual items in a particular job are to be processed is generally stored on the storage devices 404. The communications system 406 is configured to effect communications as needed with customers to receive the job files specifying such processing parameters. The communications system 406 may interface with customer computers by a connection to networks such as the internet and may comprise a wired, wireless, modem, and/or other type of interfacing connection. The central computer 104 also comprises software elements, shown as being currently located within working memory 491, including an operating system 492 and other code 493, such as a program designed to implement methods of the invention. It will be apparent to those skilled in the art that substantial variations may be used in accordance with specific requirements. For example, customized hardware might also be used and/or particular elements might be implemented in hardware, software (including portable software, such as applets), or both. Further, connection to other computing devices such as network input/output devices may be employed.

Having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. A method for operating an inserter having a plurality of hoppers from which inserts may be selected to include with a mail item having two parts, the method comprising:

reading respective identifications from each of the two parts of the mail item;

moving at least one of the two parts of the mail item sequentially to positions corresponding with the plurality of hoppers;

at each position, making a determination by reference to information extracted from a job file whether the insert in the corresponding hopper is to be included with the mail item;

cross referencing the identification for the at least one of the two parts with an entry in the job file;

including the insert with the at least one of the two parts of the mail item in accordance with the determination;

determining whether the respective identifications for the two parts correspond; and matching the two parts with the included inserts for mailing.

2. The method recited in claim 1 further comprising receiving the job file from a customer across a network.

3. The method recited in claim 1 further comprising printing a zip marker on an envelope containing the mail item.

4. The method recited in claim 1 further comprising sealing an envelope containing the mail item and any included inserts in accordance with information extracted from the job file.

5. The method recited in claim 1 further comprising metering an envelope containing the mail item and any included inserts in accordance with information extracted from the job file.

6. The method recited in claim 5 wherein metering the envelope comprises selecting at least one of a plurality of meters to perform the metering.

7. The method recited in claim 1 further comprising directing an envelope containing the mail item and any included inserts along one of a plurality of output conveyors in accordance with information extracted from the job file.

8. The method recited in claim 1 further comprising providing an operator display for monitoring operation of the inserter.

9. The method recited in claim 8 wherein the operator display includes an image of at least one of the inserts.

10. The method recited in claim 8 wherein the operator display includes a track display having elements corresponding to the positions, the method further comprising providing data about the mail item upon activation of the element corresponding to its position.

11. The method recited in claim 8 wherein the operator display includes information extracted from the job file specifying a process to be effected by the inserter on the mail item.

12. The method recited in claim 8 further comprising updating a status of the inserter according to a change effected by an operator with the operator display.

13. The method recited in claim 12 wherein the change comprises a reassignment of inserts to hoppers.

14. The method recited in claim 12 wherein the change comprises a reassignment of a position for the mail item on the inserter.

15. The method recited in claim 8 further comprising overriding a processing instruction extracted from the job file with a directive entered by an operator with the operator display.

* * * * *